United States Patent [19]

Marquardt et al.

[11] Patent Number: 4,742,200

[45] Date of Patent: May 3, 1988

[54] ACTUATING DEVICE FOR A LOW-VOLTAGE CIRCUIT BREAKER WITH A RATCHET WHEEL

[75] Inventors: Ulrich Marquardt; Ralf Seebold, both of Berlin, Fed. Rep. of Germany

[73] Assignee: Siemens Aktienfesellschaft, Berlin and Munich, Fed. Rep. of Germany

[21] Appl. No.: 929,918

[22] Filed: Nov. 12, 1986

[30] Foreign Application Priority Data

Nov. 18, 1985 [DE] Fed. Rep. of Germany ..... 3541093

[51] Int. Cl.[4] ..... H01H 3/30

[52] U.S. Cl. ..... 200/325; 200/153 SC; 200/153 G; 200/318; 335/76; 335/171; 74/2; 74/533; 185/40 R

[58] Field of Search ..... 74/2, 527, 533, 577 M, 74/577 S; 188/82.77, 82.7; 185/40 R, 40 B, 39; 200/153 SC, 153 G, 318, 320, 321–322, 323–326; 335/76, 77, 167, 169, 171

[56] References Cited

U.S. PATENT DOCUMENTS

| | | | |
|---|---|---|---|
| 3,301,984 | 1/1967 | Wilson | 200/153 R |
| 3,600,540 | 8/1971 | Bould | 200/153 SC |
| 3,689,721 | 9/1972 | McGuffie | 200/153 SC |
| 3,944,772 | 3/1976 | Davies | 200/153 SC |
| 4,095,676 | 6/1978 | Howe et al. | 185/40 R |
| 4,162,385 | 7/1979 | Bould et al. | 200/153 SC |
| 4,167,988 | 9/1979 | Acampora et al. | 185/40 R |
| 4,228,690 | 10/1980 | Ring | 74/122 |
| 4,475,021 | 10/1984 | Mochizuki et al. | 200/153 SC |
| 4,596,310 | 6/1986 | Hatakeyama et al. | 185/40 R |

*Primary Examiner*—Henry J. Recla
*Assistant Examiner*—Ernest Cusick
*Attorney, Agent, or Firm*—Kenyon & Kenyon

[57] ABSTRACT

For cocking an energy accumulator, an actuating device comprises a ratchet wheel with teeth as well as a reciprocating transport ratchet. For maintaining the cocked position of the energy accumulator, a cam wheel and blocking lever which can be braced against a blocking member via a ratchet lever are provided. Due to a wedge-like cooperation between a working surface of the cam wheel and a projection of the blocking lever, the blocking lever is transferred from its rest position into a blocked position if the deadcenter position of the cam wheel is exceeded. In the process, the transport ratchet is lifted from the teeth of the ratchet wheel by means of a striking surface of the blocking lever.

7 Claims, 2 Drawing Sheets

ACTUATING DEVICE FOR A LOW-VOLTAGE CIRCUIT BREAKER WITH A RATCHET WHEEL

BACKGROUND OF THE INVENTION

The present invention relates to an actuating device for a low-voltage circuit breaker with a ratchet wheel which can be rotated step-wise by a transport ratchet for cocking an energy accumulator, where a cam wheel connected to the ratchet wheel can be blocked, if the energy accumulator is cocked against further rotation by a blocking lever and a latching device at a point beyond dead center with respect to the force application of the energy accumulator at the ratchet wheel.

An actuating device of this type has become known, for instance, through U.S. Pat. No. 3,301,984. Regardless of the type of actuation of the ratchet wheel, the difficulty arises in such actuating devices that further introduction of force into the ratchet wheel, when the end position of the energy accumulator is reached, must be stopped because otherwise there is danger of parts of the actuating device being damaged. If, for instance, the transport ratchet of the ratchet wheel is actuated by a motor drive, a special control of the motor is necessary in order to ensure that, on the one hand, the energy accumulator is completely charged and on the other hand, continuous running of the motor beyond this operating point is stopped so that the motor, associated transmission parts as well as the ratchet wheel and the transport ratchet are not damaged. Basically the same problem exists if the ratchet wheel is rotated by a manually driven transport ratchet because forces leading to damage can also be exerted by careless operation of an actuating handle.

SUMMARY OF THE INVENTION

It is an object of the present invention to provide a reliably operating protective device against excessive stress of the actuating device if the cocked end position of the actuating device is reached.

The above and other objects of the present invention are achieved by an actuating device for a low-voltage circuit breaker having a ratchet wheel which can be rotated step-wise by a transport ratchet for cocking an energy accumulator, wherein a cam wheel connected to the ratchet wheel can be blocked, with the energy accumulator cocked, by a blocking lever and a latching device in a position beyond dead center with respect to the force engagement of the energy accumulator at the ratchet wheel against rotation in the direction of releasing the energy accumulator, the blocking lever being supported tiltably between a rest position and a blocking position, the cam wheel and the blocking lever have working surfaces cooperating in the sense of transferring the blocking lever into the blocking position, and the blocking lever having a stopping surface for lifting the transport ratchet from the teeth of the ratchet wheel.

If the actuating device is designed in this manner, the transport ratchet is automatically lifted from the teeth of the ratchet wheel as soon as the energy accumulator is fully charged and the blocking lever becomes effective. It can be achieved by suitable design of the cam wheel and the blocking lever that, in the course of a slight further rotation of the ratchet wheel beyond the dead center position, the blocking lever is shifted from its rest position into the blocking position, and this shift is utilized for lifting the transport ratchet.

It has been found that the blocking lever and the transport ratchet can be brought into mutual connection directly by the provision that the transport ratchet is equipped with a driver pin cooperating with the contact surface of the blocking lever and serves as an abutment of a pressure spring for the transport ratchet. At the same time, a separate pressure spring for the blocking lever is eliminated thereby.

The striking surface of the blocking lever can be designed as a part of a recess extending beyond the driver of the transport ratchet. In this manner the tilting angle of the transport ratchet is limited in a desired manner.

According to a further embodiment of the invention, a gentle course of motion during the lifting of the transport ratchet can be achieved by the provision that the working surface of the cam wheel cooperating with the blocking lever is arranged at an angle causing a wedge-like engagement at the blocking lever. The shift of the blocking lever from its rest position into the blocking position therefore does not take place suddenly but proportionally to the angular rotation of the ratchet wheel or the cam wheel. Accordingly, the motion of the transport ratchet is controlled as a function of the travel distance. This results in an advantageous motion cycle of the further elements of the latching device, especially of a ratchet lever which can be set against a blocking member. To this motion cycle a further contribution can be made in that the ratchet lever can be swung by the blocking lever against the action of gravity and thereby, the ratchet projection and the blocking member can be preserved.

As already mentioned, the difficulty generally exists if a motor drive is used for rotating the ratchet wheel, to shut down the motor in such a way that on the one hand the energy accumulator is completely cocked and on the other hand, an undesirable stress on the mechanism is eliminated. In this connection, it is found to be advantageous to provide, for actuating a switch located in the supply circuit of the motor, a cam connected to the ratchet wheel and a control lever cooperating with the circumferential surface of the latter. This arrangement permits actuating the switch so precisely that the motor can be shut off immediately after the cocking operation is completed and thereby, an undesired start-up beyond the permissible speed range is prevented.

To this end, the cam can comprise, starting from a circumferential circular-arc-shaped surface, a radial step and a control curve rising from the bottom of the step to the circumferential surface, while the control lever has a projection cooperating with the step. In this manner, a step-like actuation of the switch in the supply circuit of the motor is achieved. Therefore, simple switches without a step function of their own can be used without detriment.

BRIEF DESCRIPTION OF THE DRAWINGS

The present invention will be explained in greater detail in the following detailed description with the aid of the embodiment shown in the drawings, in which.

DETAILED DESCRIPTION

Figure 1:
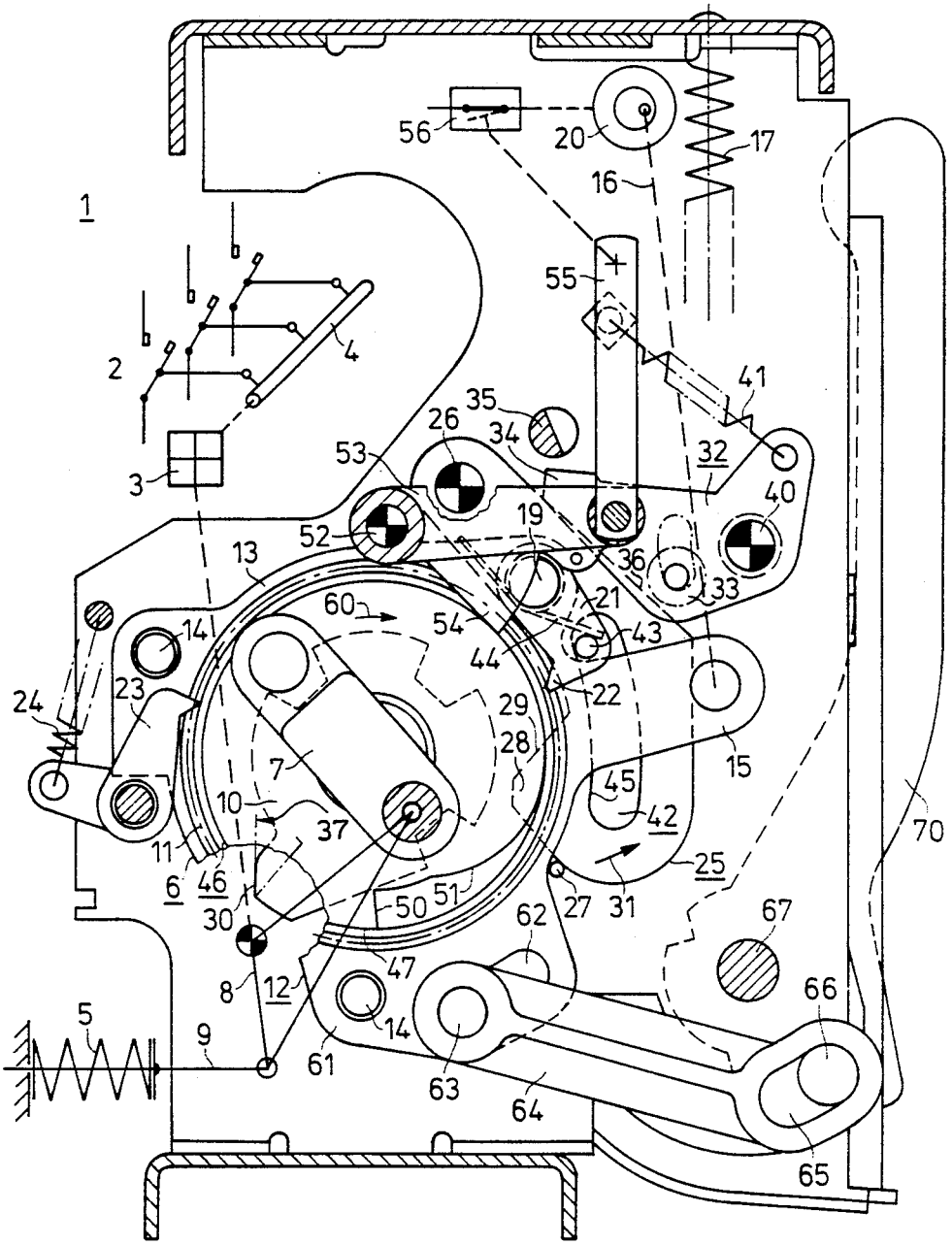
FIG. 1 shows an actuating device of a low-voltage circuit breaker with adjoining parts of the breaker, in a side view.
Figure 2:
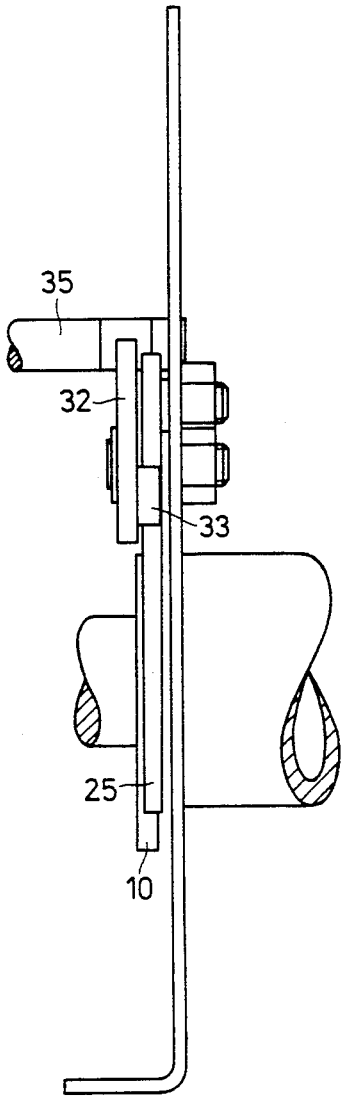
FIG. 2 shows parts of the actuating device which are at right angles to FIG. 1 and which are covered up in that figure.
Figure 3:
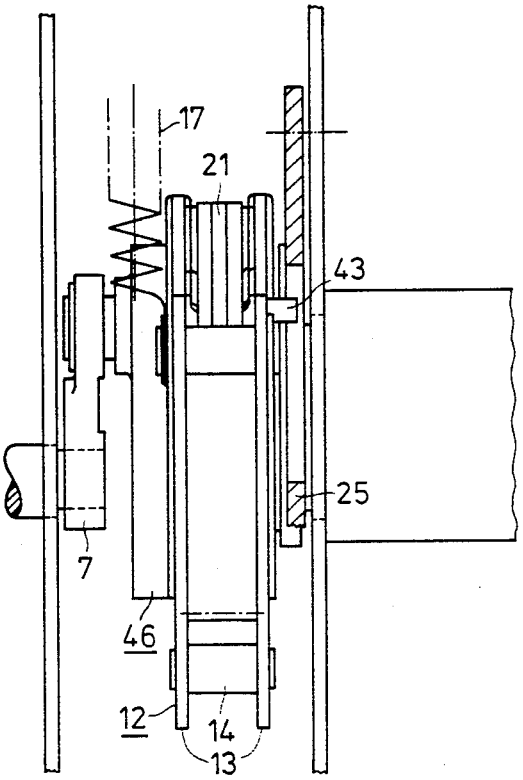
FIG. 3 shows further parts of the actuating device in a view similar to FIG. 2 but lying in a different plane, a blocking lever being shown in a sectional view.

The actuating device 1 shown in FIGS. 1 and 2 serves for the sudden closing of schematically shown contact arrangements 2 which can be actuated by the actuating device 1 with the interposition of a control device 3, likewise shown schematically via a control shaft 4. To this end, an energy accumulator which is schematically shown in FIG. 1 as a compression springs, is cocked in a manner yet to be described. This may also be a group of compression springs or an equivalent arrangement of tension springs. Since the actuating devices of low-voltage circuit breakers must be designed so that the contact arrangements 2 can be closed safely also in the event of a short circuit, the energy accumulator must be capable of storing an appropriate supply of energy; it is accordingly necessary to make a large force available for cocking the energy accumulator. This is accomplished by a ratchet wheel 6 which can be transported step-wise, in conjunction with a crank arm rocker 7 and a stationarily supported two-arm rocker 8, the one end of which is connected via a joint to the crank rocker 7 and at the other end of which a guiding rod 9 engages for cocking the compression spring 5.

On both sides of the teeth 11 of the ratchet wheel 6, a carrier or cage 12 is supported at its wheel body which is formed by two parallel support plates 13 and bolts 14 connecting the same. The cage 12 has an extension 15, which is engaged by a push rod 16 as well as a restoring spring 17. The push rod 16 serves for transmitting a reciprocating motion to the cage 12 by means of a motor drive 20 shown schematically. A transport ratchet 21 which can be rotated about a pivot 19 in the support plates 13 of the cage 12 is engaged with its projection 22 with the teeth 11 of the ratchet wheel 6 thereby to convert the rotary motion of the motor drive 20 into a step-wise rotation of the ratchet wheel 6 in the direction of the arrow 60 and a corresponding step-wise tensioning of the compression spring 5. A stationary latching ratchet 23 is likewise kept in engagement with the teeth 11 by means of a restoring spring 24 and prevents a reverse rotation of the ratchet wheel 6 during the tensioning operation.

So that the circuit breaker can be closed at a desired instant, it is necessary to keep in readiness the energy stored in the compression spring 5 so that it can be called up. This is accomplished by a blocking lever 25 in connection with a latching device composing elements 32, 34 and 35, (the operation of which will be described later) which prevents further rotation of the ratchet wheel 6 as soon as the latter has exceeded its dead-center position with respect to the direction of force of the tension spring 5. To this end, the blocking lever 25 is pivoted in a suspended position about a stationary bearing pin 26 and can be put against a stationary stop 27 under the action of gravity. At a projection 28 of the blocking lever 25, there is a working surface 29 which cooperates with a working surface 30 of cam wheel 10 connected to the ratchet wheel 6, this working surface 30 being arranged with a heavy inclination relative to a radial line (angle 37 in FIG. 1). Thereby a wedge-like cooperation between the working surface 30 of the cam wheel 10 and the projection 28 of the blocking lever 25 is provided in such a manner that the blocking lever 25 is swung not suddenly but in the course of a certain angle of rotation (arrow 60) of the cam wheel 10 from the rest position shown in FIG. 1 against the action of gravity about the bearing pin 26 in the direction of the arrow 31. From its rest position, the blocking lever 25 is thereby transferred into a blocking position, in which a ratchet lever 32 equipped with a roll 33 and a projection 34 rests against a blocking lever designed as a half shaft 35. The blocking lever 25 cooperates here with the roll 33 by a shoulder 36 facing away from the ratchet wheel 6.

Since the ratchet lever 32 is arranged to be tiltable about the bearing pin 40 in an approximately horizontal position, not only the action of a return spring 41 but also the force of gravity must be overcome when it is transferred into the blocked position. In connection with the wedge-like cooperation to the working surface 30 of the cam wheel 10 with the projection 28 of the blocking lever 25, this leads to a gentle motion cycle which thereby preserves all cooperating parts.

The blocking lever 25 is provided with a recess 42, into which protrudes a driving pin 43 of the transport ratchet 21. The driving pin is acted upon by a flexing spring 44 with a restoring force which keeps the transport ratchet 21 in engagement with the teeth 11. The recess 42 is designed so that the transport ratchet 21, with the rest position of the blocking lever 25 unchanged, can execute the motions required for continued rotation of the ratchet wheel 6, in the circumferential direction as well as in the radial direction. If, however, the blocking lever 25 is transferred into its blocked position in the direction of the arrow 31 in the described manner, the radially inward striking surface 45 of the recess 42 hits against the driver pin 43 and thereby lifts the projection 22 out of the transport ratchet from the teeth 11 of the ratchet wheel 6 and therefore against the force of the flexing spring 44. In this manner the motor drive 20 and the ratchet wheel 6 are completely decoupled from each other so that any damage to the motor drive 20, the ratchet wheel 6 and all elements in between is impossible. For shutting down the motor drive 20, an interruption of the supply circuit is therefore sufficient if the tension spring is fully cocked. The motor can then run down freely.

A device provided for shutting down the motor drive 20 will be described in the following. It comprises, first, a control cam 46 which is connected to the cam wheel 10 or the ratchet wheel 6. The control cam 46 has, starting from the circular arc-shaped circumferential surface 47, a step 50 which extends radially inward and is followed by a curve 51 rising to the radius of the circumferential surface 47. A control lever 53 rotatably supported about a pin 52 approximately above the ratchet wheel 6 is provided with a projection 54 which cooperates with the control cam 46. The control lever 53 is further connected articulated with an operating rod 55 which actuates one or more auxiliary switches, of which a motor switch 56 is shown in FIG. 1. In the position shown, this switch is closed so that the supply circuit of the motor drive can be closed by means of a control switch. In the manner already described, the ratchet wheel 6 is then transported step-wise in the direction of the arrow 60 until the blocking lever 25 becomes effective. The control cam 46 and the control lever 53 are related to each other in such a way that, if the end position of the cam wheel 10 is reached, the radial step 50 of the control cam 46 arrives at the projection 54 of the control lever 53 and thereby, the control lever can execute a rotation about its bearing (bolt 52) in the course of a very small angular rotation of the control cam 46. This tilting motion is transmitted by means of the actuating rod 55 to the motor switch 56 which interrupts the circuit of the motor drive 20. At the same time, further position-dependent events can be triggered, for instance, a mechanical indicating element can be actuated at a control panel of the circuit breaker.

The release of the compression spring 5 for switching-on the circuit breaker, i.e., for closing the contact arrangements 2 shown schematically in FIG. 1, is accomplished in the manner known per se by releasing the ratchet lever 32 by means of a blocking member 35. If the blocking member is designed in the manner shown as a halfshaft, a rotation by a few degrees of angle is sufficient to let the ratchet projection 34 pass through the recess of the half-shaft. Thereby, the engagement of the blocking lever 25 by the roll 33 of the ratchet lever 33 is canceled so that then, the blocking lever can swing from its blocking position further in the direction of the arrow 31 into its release position. This motion is carried out by the blocking lever 25 under the influence of the wedge-like cooperation between the working surface 30 of the cam 10 and the projection 28 with its working surface 29. As soon as the ratchet wheel 6 and the cam 46 have executed a certain amount of rotation in the direction of the arrow 60, the control lever 53 is returned by means of the curve 51 into the starting position shown. The control lever can be set with its projection 54, in addition to the force of gravity, by pressure against the circumferential surface on the control disc 46; the pressure can be supplied by a separate spring or the restoring force of the components to be actuated.

In the embodiment shown, the cage 12 has, in addition to the extension 15, a further extension 61 with an arc-shaped elongated hole 62 for the pin 63 of a push rod 64. This push rod in turn is provided at its opposite end with an arc-shaped elongated hole 65 which is engaged by a pin 66 of a manual operating lever 70 supported at 67. Due to the elongated hole 62, the cage 12 can move for cocking the compression spring 5 by means of the motor drive 20 without influencing the manual actuating lever 70. If, on the other hand, the motor drive 20 is at rest, the ratchet wheel 6 can likewise be transported step-wise by means of the actuating handle 70 and the push rod 64, where the cage 12 and the transport ratchet 21 again serve for transmitting the power. Thus, also the manual actuating lever 70 is made inoperative automatically if the blocking lever 25 has arrived at its blocking position in the end position of the cam wheel 10 and thereby, the transport ratchet 21 is lifted out of the teeth 11.

In the foregoing specification, the invention has been described with reference to a specific exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. An actuating device for a low-voltage circuit breaker comprising a ratchet wheel having teeth, said ratchet wheel being rotated step-wise by a reciprocating arrangement comprising a rotatably mounted carrier and a transport ratchet supported on the carrier, said transport ratchet engaging the teeth of said ratchet wheel, said ratchet wheel provided for cocking an energy accumulator, and further comprising a cam wheel connected to the ratchet wheel, the ratchet wheel adapted to be blocked, with the energy accumulator cocked, by a blocking lever and a latching device cooperating with the blocking lever in a position beyond dead center with respect to the direction of force of the energy accumulator at the ratchet wheel against rotation in the direction of releasing the energy accumulator, the blocking lever being supported tiltably on a fixed pivot between a rest position and a blocking position, the cam wheel and the blocking lever having working surfaces cooperating such that the blocking lever is biased into the blocking position by the cam wheel at a particular point in the rotation of said ratchet wheel when said energy accumulator is sufficiently cocked, the blocking lever further having an operating surface for lifting the transport ratchet from the teeth of the ratchet wheel.

2. The actuating device recited in claim 1, wherein the transport ratchet has a driving pin cooperating with the operating surface of the blocking lever which serves as an abutment of a spring means for biasing the transport ratchet against the ratchet wheel.

3. The actuating device recited in claim 2, wherein the operating surface is part of a recess of the blocking lever surrounding the driving pin of the transport ratchet.

4. The actuating device recited in claim 1, wherein the working surface of the cam wheel which cooperates with the blocking lever is arranged at an angle causing a wedge-like engagement at the blocking lever.

5. The actuating device recited in claim 4, wherein the latching device comprises a ratchet lever which, starting from a rest position, can be tilted against the action of gravity, said ratchet lever having a projecting sureface which can rest against a releasable blocking member, said releasable blocking member being actuable to move said blocking lever into a release position to release said energy accumulator.

6. The actuating device recited in claim 1, wherein, for actuating a switch located in a supply circuit of a motor drive, a control cam is further provided connected to the ratchet wheel and a control lever cooperating with a circumferential surface of the control cam is provided.

7. The actuating device recited in claim 6, wherein the control cam has a circular arcshaped circumferential surface interrupted by a step and a control curve rising from a bottom surface of the step to the circumferential surface, the control lever having a projection cooperating with the circumference of the control cam.

* * * * *